US008250778B2

(12) United States Patent
Hodges

(10) Patent No.: US 8,250,778 B2
(45) Date of Patent: Aug. 28, 2012

(54) CLOTHES DRIVER AIR INTAKE SYSTEM

(76) Inventor: Timothy M. Hodges, Moselle, MS (US)

( * ) Notice: Subject to any disclaimer, the term of this patent is extended or adjusted under 35 U.S.C. 154(b) by 126 days.

(21) Appl. No.: 12/384,038

(22) Filed: Mar. 31, 2009

(65) Prior Publication Data

US 2009/0191808 A1 Jul. 30, 2009

Related U.S. Application Data

(63) Continuation of application No. 11/819,770, filed on Jun. 29, 2007, now abandoned.

(51) Int. Cl.
*F26B 13/00* (2006.01)

(52) U.S. Cl. ..... 34/601; 34/606; 34/610; 126/588; 165/162

(58) Field of Classification Search ..... 34/601, 34/606, 610, 90, 210, 235, 242; 165/162; 126/588
See application file for complete search history.

(56) References Cited

U.S. PATENT DOCUMENTS

| | | | | | |
|---|---|---|---|---|---|
| 2,001,663 | A | * | 5/1935 | Carlson | 165/162 |
| 2,024,062 | A | * | 12/1935 | Preedit | 34/134 |
| 2,290,333 | A | * | 7/1942 | Johnson | 285/55 |
| 2,441,357 | A | * | 5/1948 | Hibbert | 34/540 |
| 2,680,437 | A | * | 6/1954 | Miller | 126/649 |
| 2,878,581 | A | * | 3/1959 | Turati | 34/92 |
| 2,907,318 | A | * | 10/1959 | Awot | 126/658 |
| 3,020,648 | A | * | 2/1962 | Strike | 34/599 |
| 3,050,867 | A | * | 8/1962 | Friedman | 34/86 |
| 3,066,423 | A | * | 12/1962 | Solem | 34/86 |
| 3,081,554 | A | * | 3/1963 | Long | 34/543 |
| 3,231,986 | A | * | 2/1966 | Touton | 34/219 |
| 3,254,423 | A | * | 6/1966 | Ruelle | 34/543 |
| 3,639,998 | A | * | 2/1972 | Mason | 34/82 |
| 3,673,825 | A | * | 7/1972 | Schuierer | 68/20 |
| 3,718,982 | A | * | 3/1973 | Deaton | 34/82 |
| 3,816,070 | A | * | 6/1974 | Candor et al. | 8/158 |
| 3,892,049 | A | * | 7/1975 | Adams, Jr. | 34/235 |
| 3,894,685 | A | * | 7/1975 | Keyes et al. | 126/616 |
| 3,919,998 | A | * | 11/1975 | Parker | 126/634 |
| 3,949,732 | A | * | 4/1976 | Reines | 126/597 |
| 3,964,268 | A | * | 6/1976 | DiPeri | 62/121 |
| 3,969,070 | A | * | 7/1976 | Thompson | 432/105 |
| 4,003,139 | A | * | 1/1977 | Van Winkle | 34/86 |
| 4,027,821 | A | * | 6/1977 | Hayes et al. | 126/588 |
| 4,086,707 | A | * | 5/1978 | Bochan | 34/554 |
| 4,122,828 | A | | 10/1978 | DiPeri | |
| 4,186,720 | A | * | 2/1980 | Schmauder et al. | 126/667 |
| 4,197,830 | A | * | 4/1980 | Wilson | 126/620 |
| 4,204,339 | A | * | 5/1980 | Muller | 34/75 |

(Continued)

FOREIGN PATENT DOCUMENTS

EP 406181 A1 * 1/1991

(Continued)

*Primary Examiner* — Stephen M. Gravini
(74) *Attorney, Agent, or Firm* — Maier & Maier, PLLC

(57) ABSTRACT

A clothes dryer air intake system including a conduit having an outlet opening for connection to a clothes dryer and being positioned remote from the attic of a building. The conduit also has an inlet opening positioned within the attic of a building. A heater is connected to the conduit between the outlet opening and the inlet opening for warming air passing through the conduit. A thermostat detects the temperature of the air flowing through the conduit and energizes the heater in the event that the detected temperature is lower than a preset minimum.

1 Claim, 1 Drawing Sheet

U.S. PATENT DOCUMENTS 4,219,010 A * 8/1980 Van Heel ..... 126/620
4,227,315 A * 10/1980 Hight ..... 34/82
4,236,320 A * 12/1980 Schwadike et al. ..... 34/428
4,237,621 A * 12/1980 Boismenu ..... 34/108
4,240,581 A * 12/1980 Fowler ..... 237/12.1
4,256,176 A * 3/1981 Cohen ..... 165/76
4,287,942 A * 9/1981 Whitman ..... 165/10
4,287,945 A * 9/1981 Hessari ..... 165/167
4,291,681 A * 9/1981 Berringer ..... 126/673
4,303,060 A * 12/1981 Mart ..... 126/671
4,309,987 A * 1/1982 Higgins, Jr. ..... 126/664
4,313,429 A * 2/1982 McAlaster ..... 126/667
4,331,503 A * 5/1982 Benjamin ..... 216/33
4,397,305 A * 8/1983 Keefe ..... 126/665
4,429,472 A * 2/1984 Dodelin et al. ..... 34/549
4,474,226 A * 10/1984 Greiner et al. ..... 165/164
4,514,914 A * 5/1985 Kitzmiller ..... 34/93
4,615,328 A * 10/1986 Wetzel, Jr. ..... 126/646
4,621,614 A * 11/1986 Sykes, Jr. ..... 126/617
4,689,896 A 9/1987 Narang
4,735,609 A * 4/1988 Comeau et al. ..... 604/114
4,834,149 A * 5/1989 Fournier et al. ..... 141/1
4,875,298 A 10/1989 Wright
4,890,396 A * 1/1990 King ..... 34/235
4,891,892 A 1/1990 Narang
5,117,563 A * 6/1992 Castonguay ..... 34/86
5,270,017 A * 12/1993 Schwartz, Jr. ..... 422/209
5,312,599 A * 5/1994 Schwartz, Jr. ..... 422/209
5,359,820 A * 11/1994 McKay ..... 52/34
5,476,183 A * 12/1995 Harpenau ..... 220/3.3
5,590,477 A * 1/1997 Carfagno, Sr. ..... 34/235
5,709,040 A * 1/1998 Horwitz ..... 34/565
5,822,883 A * 10/1998 Horwitz ..... 34/494
5,915,735 A * 6/1999 Noble ..... 285/4
6,067,730 A * 5/2000 Woods ..... 34/603
6,082,022 A * 7/2000 St. Louis ..... 34/602
6,101,715 A * 8/2000 Fuesser et al. ..... 29/890.03
6,154,978 A * 12/2000 Slutsky ..... 34/321
6,202,321 B1 * 3/2001 Soucy ..... 34/507
6,230,418 B1 * 5/2001 Gomulinski ..... 34/140
6,272,770 B1 * 8/2001 Slutsky et al. ..... 34/596
6,334,267 B1 * 1/2002 Slutsky ..... 34/606
6,419,102 B1 * 7/2002 Harpenau ..... 220/3.3
6,438,862 B1 * 8/2002 Soucy ..... 34/168
6,550,157 B1 * 4/2003 Harding ..... 34/140
6,618,958 B2 * 9/2003 Myung et al. ..... 34/602
6,671,977 B2 * 1/2004 Beaumont ..... 34/79
6,688,018 B2 * 2/2004 Soucy ..... 34/68
6,715,216 B1 * 4/2004 Salameh et al. ..... 34/350
6,745,495 B1 * 6/2004 Riddle et al. ..... 34/497
6,754,976 B1 6/2004 Edwards
6,941,680 B1 * 9/2005 Zielewicz et al. ..... 34/607
7,017,280 B2 * 3/2006 Green et al. ..... 34/486
7,040,039 B1 * 5/2006 Stein et al. ..... 34/529
7,043,944 B2 * 5/2006 Park et al. ..... 68/20
7,047,664 B1 * 5/2006 Martinez ..... 34/380
7,069,669 B2 * 7/2006 Park et al. ..... 34/603
7,134,221 B2 * 11/2006 Stein et al. ..... 34/381
7,213,349 B1 * 5/2007 Brunner ..... 34/86
7,320,185 B2 * 1/2008 Heyder et al. ..... 34/602
7,337,553 B2 * 3/2008 Stein et al. ..... 34/381
7,627,960 B2 * 12/2009 Beyerle et al. ..... 34/602
7,644,514 B2 * 1/2010 Heyder et al. ..... 34/595
7,644,515 B2 * 1/2010 Doh ..... 34/603
7,681,419 B2 * 3/2010 Naber et al. ..... 68/18 F
7,694,434 B2 * 4/2010 Lee ..... 34/607
7,735,239 B2 * 6/2010 Jeong et al. ..... 34/282
7,748,137 B2 * 7/2010 Wang ..... 34/396
7,788,876 B2 * 9/2010 Yasui ..... 52/741.1
7,886,458 B2 * 2/2011 Blair ..... 34/83
7,895,771 B2 * 3/2011 Prajescu et al. ..... 34/603
7,908,766 B2 * 3/2011 Ahn et al. ..... 34/595

FOREIGN PATENT DOCUMENTS

EP 436374 A2 * 7/1991
JP 54065873 A * 5/1979
JP 58208018 A * 12/1983
JP 04364900 A * 12/1992
JP 05293010 A * 11/1993
JP 11173620 A * 7/1999
JP 2000233631 A * 8/2000

* cited by examiner

CLOTHES DRIVER AIR INTAKE SYSTEM

CONTINUING APPLICATION DATA

This application is a continuation of U.S. patent application, Ser. No. 11/819,770, filed on Jun. 29, 2007, now abandoned.

FIELD OF THE INVENTION

The present invention relates generally to drying and gas or vapor contact with solids and, more particularly, to apparatus utilizing waste gas heat and/or power conservers.

BACKGROUND OF THE INVENTION

One hundred sixty cubic feet of air pass through a typical clothes dryer each minute the dryer is operating. Within the dryer, this air is heated and drawn past tumbling clothes to remove moisture from the clothes. Moistened air is subsequently blown through a duct from the -dryer and the building within which the dryer sits.

Running a dryer for forty-five minutes causes 7,200 cubic feet of air to be removed from a building. Since a dryer is typically run eight times in a week, the dryer blows nearly three million cubic feet of air to the atmosphere in a year. Since much of this air is either heated or cooled by conventional HVAC systems prior to it entering the dryer, the energy waste is enormous.

The blowing of air from a building by a dryer creates a negative pressure differential that causes air to leak into a building. One common place where air can leak into a building is through vent pipes such as those associated with gas furnaces or water heaters. If one of these appliances is in use, the dryer will pull the combustion product, carbon monoxide, back into the building, perhaps with deadly consequences for the occupants of the building.

SUMMARY OF THE INVENTION

In light of the problems associated with the known manner in which clothes dryers operate, it is a principal object of my invention to provide an air intake system for a clothes dryer that utilizes air, heated by the radiant energy of the sun, in the attic of a home or other building structure. Rather than venting this attic air directly back to the atmosphere in accordance with usual practices, attic air is caused to flow through a clothes dryer so that the dryer does not employ air from the occupied space of a building. My system conserves energy by utilizing the radiant energy of the sun rather than other means within a clothes dryer to heat air. Furthermore, since attic air is not drawn from within the occupied space of a building, the occupied space is never subjected to a vacuum that can draw carbon monoxide into it. Thus, my system enhances safety within an occupied building.

It is another object of the invention to provide a system of the type described that can be installed in buildings that are newly constructed or can be retrofit into old structures. Installation can be accomplished easily, with conventional tools and with minimal training. Additionally, my system can be used with most makes and models of clothes dryers.

It is an object of the invention to provide improved features and arrangements thereof in a clothes dryer air intake system for the purposes described which is lightweight in construction, inexpensive to manufacture, and dependable in use.

The foregoing and other objects, features, and advantages of the present invention will become readily apparent upon further review of the following detailed description of the air intake system illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE AIR INTAKE SYSTEM

Figure 1:
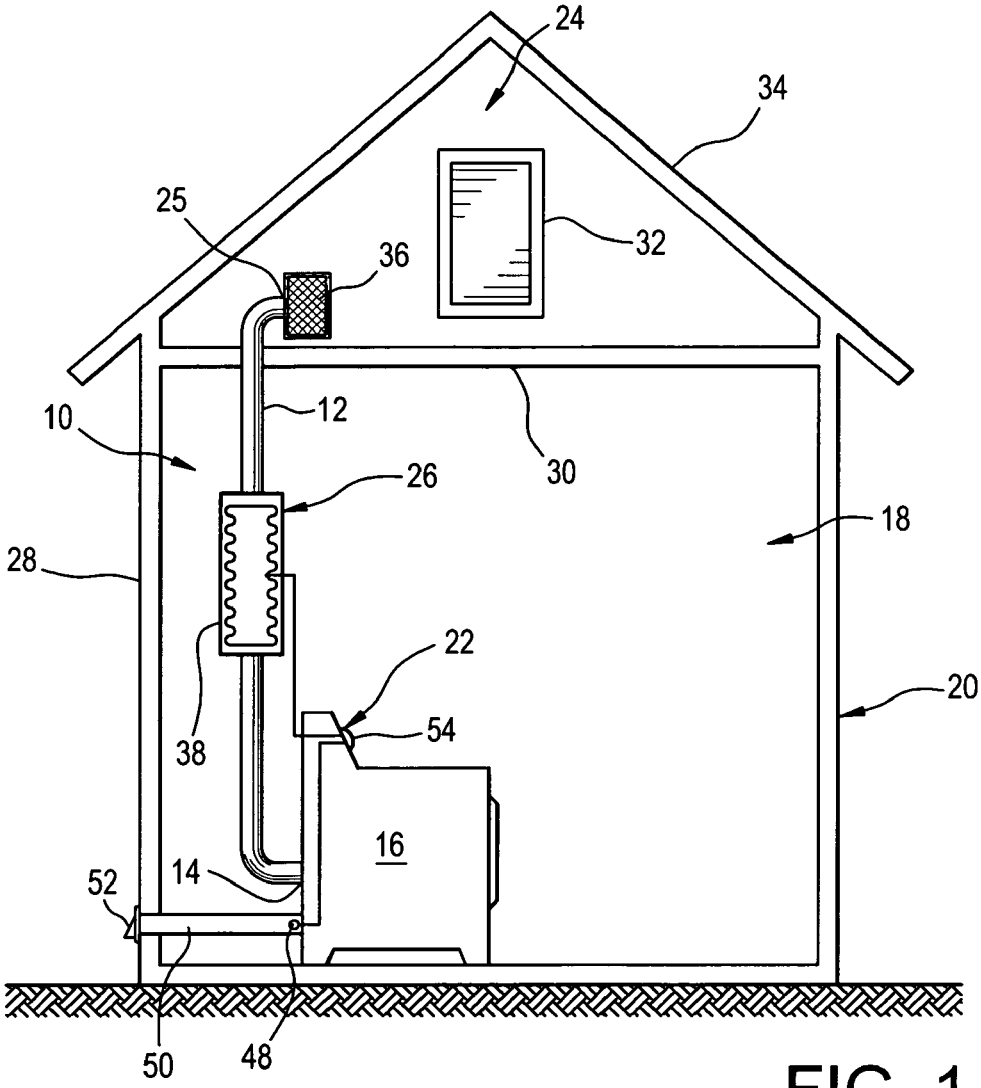
FIG. 1 is a schematic diagram of a clothes dryer air intake system in accordance with the present invention shown installed within a building.
Figure 2:
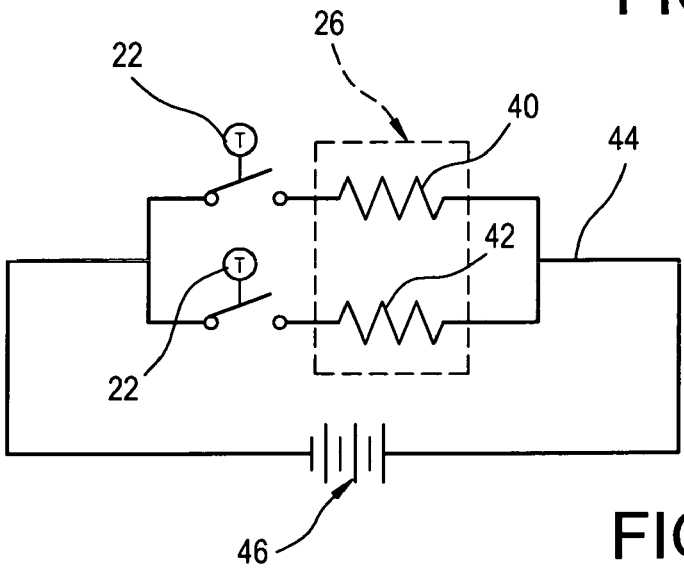
FIG. 2 is a schematic diagram of the electrical circuit of my clothes dryer air intake system.

Referring now to the FIGS., a clothes dryer air intake system in accordance with the present invention is shown at 10. System 10 includes a tubular conduit 12 having an outlet opening 14 terminating at a clothes dryer 16 in the occupied space 18 of a building 20 and an inlet opening 25 positioned remote from dryer 16 in the attic 24 of building 20. A thermostat 22 is provided to judge the warmth of the air exiting dryer 16 and to energize a supplemental heater 26 connected to conduit 12 in the event that the air drawn from attic 24 has a temperature that is insufficient to dry clothes in dryer 16.

Outlet opening 14 of conduit 12 is connected to clothes dryer 16 in such a manner that little, if any, air entering dryer 16 for clothes drying purposes is drawn from occupied space 18. In this regard, outlet opening 14 or dryer 16 or both may require special fittings or seals (not shown) to exclude air from occupied space 18. Such fittings or seals would be configured differently for different makes and models of clothes dryers 16.

Conduit 12 extends upwardly from dryer 16 adjacent to, or within, a building wall 28 and through ceiling 30. Conduit 12 terminates at inlet opening 25 positioned immediately above ceiling 30 and remote from attic vent 32. If desired, however, conduit 12 could be extended upwardly so as to terminate adjacent the apex of the roof 34 of building 20 so that the hottest air in attic 24 can be always be accessed. Regardless of where inlet opening 25 is positioned, it is covered by a fine screen 36 to prevent dust, dirt, and insects from entering conduit 12 and traveling to dryer 16.

Conduit 12 is made from flexible tubing, of a type commonly used for HVAC work, having a diameter sufficient to deliver an adequate air supply to dryer 16. If desired, conduit 12 can be formed of aluminum sheeting, folded and joined to form hollow tubing. PVC pipe could also be used because of its light weight, low cost, and extreme durability. Aluminum and PVC installations can be costly, however.

Heater 26 is connected to conduit 12 and includes a housing 38 that is molded from plastic, or formed from any other suitable material, so as to include openings at both ends for an in-line connection to conduit 12. A number of perforated tabs (not shown) can be integrally formed with housing 38 at spaced-apart locations for mounting heater 26 upon, or within, wall 28. Although heater 26 is shown to be installed with a vertical orientation in the FIGS., it can be mounted in any desired orientation.

Housing 38 supports within its confines a pair of electrical resistance-heating elements 40 and 42, formed of Nichrome wire and separated by ceramic insulators, for warming air admitted from conduit 12. Heating elements 40 and 42 are energized by selectively connected them through electrical leads 44 to an electrical current source 46. When connected to current source 46, heating elements 40 and 42 emit heat sufficient to dry clothes at rapid rate without damage.

Heating elements 40 and 42 are connected in parallel through leads 44 to electrical current source 46 so that one or both of heating elements 40 and 42 can be energized at a given time. Thus, when both heating elements 40 and 42 are energized, the heat output of heater 26 is effectively increased.

The heat output of heating elements 40 and 42 is a matter of design choice. High heat, capable of drying large loads of clothes at a rapid rate, requires that heating elements 40 and 42 be constructed to handle more electricity at greater cost. Installations of system 10 at higher latitudes or elevations may require greater heat outputs to compensate for colder air temperatures during winter months.

Thermostat 22 includes a temperature probe 48 that is positioned within a duct 50 that passes outwardly through wall 28 to vent moistened air from dryer 16 to the atmosphere. (A shutter 52 mounted on the exterior of wall 28 covers the outlet of duct 50 and prevents the unintended entry of matter into duct 50 so as to harm probe 48.) Probe 48 determines the temperature of the air being discharged by dryer 16.

Probe 48 is operatively connected to a gauge 54 that is positioned atop dryer 16 for easy reading by a user. The gauge 54 not only displays the temperature of the air found by probe 48, but serves as a switch to the operation of heater 26. If, gauge 54 senses that air flowing through duct 50 has a temperature of less than 120° F., then heating element 40 alone is energized to deliver heat to dryer 16. If, however, gauge 54 senses that air flowing through duct 50 has a temperature of less than 95° F., then heating element 42 is energized in addition to heating element 40 to deliver the maximum heat to dryer 16.

When clothes dryer 16 is turned "on," a fan (not shown) positioned within, and normally being part of, dryer 16 is energized so as to draw about 160 cubic feet of air per minute, into inlet opening 25 and out of outlet opening 14 into dryer 16. This air, heated by radiant solar energy, in attic 24 is pulled past damp clothes being tumbled within a rotating drum in dryer 16. Water is evaporated from the clothes by the flowing air and the moistened air is discharged from dryer and building through duct 50. If the temperature of the air being drawn through dryer 16 is too low, as determined by thermostat 22, then one or both of heating elements 40 and 42 within heater 26 are energized to raise the air's temperature. Air within attic 24, however, is normally warmed to a temperature that is sufficient to dry clothes, especially during summer months.

While system 10 has been described with a high degree of particularity, it will be appreciated by those skilled in the art that modifications can be made to it. Therefore, it is to be understood that the present invention is not limited to the sole embodiment described above, but encompasses any and all embodiments within the scope of the following claims.

I claim:

1. A clothes dryer air intake system for use in a building having: a roof, an occupied space being located below the roof, and an attic being positioned between the occupied space and the roof; said system comprising:

a tubular conduit for transporting air from the attic to the occupied space of the building, said conduit having an air outlet opening being adapted for connection to a clothes dryer being located in the occupied space of the building and, also, having an air inlet opening being positioned within the attic of the building;

a supplemental heater for warming air passing through said conduit, said supplemental heater being positioned within the occupied space of the building and being connected to said conduit between said air outlet opening and said air inlet opening; and, a thermostat for detecting the temperature of the air flowing through said conduit and energizing said supplemental heater in the event that the detected air temperature is lower than a preset minimum.

* * * * *